United States Patent [19]

Hope et al.

[11] Patent Number: 5,074,717

[45] Date of Patent: Dec. 24, 1991

[54] CLAMPED BODY REPLACEMENT TOOL

[75] Inventors: Rodney C. Hope, Southampton; John E. Lawson; Stephen A. Hatton, both of Woking, all of United Kingdom

[73] Assignee: Mobil Oil Corporation, Fairfax, Va.

[21] Appl. No.: 543,736

[22] PCT Filed: Feb. 6, 1989

[86] PCT No.: PCT/GB89/00101

§ 371 Date: Oct. 5, 1990

§ 102(e) Date: Oct. 5, 1990

[87] PCT Pub. No.: WO89/07191

PCT Pub. Date: Aug. 10, 1989

[30] Foreign Application Priority Data

Feb. 6, 1988 [GB] United Kingdom ..... 8802737
Aug. 22, 1988 [GB] United Kingdom ..... 8819910

[51] Int. Cl.[5] ..... B63C 11/52

[52] U.S. Cl. ..... 405/303; 166/339; 405/169; 405/190

[58] Field of Search ..... 405/158, 169, 185, 188, 405/190, 191, 303; 166/339, 340, 365; 285/18

[56] References Cited

U.S. PATENT DOCUMENTS

| | | | |
|---|---|---|---|
| 3,481,396 | 12/1969 | Williams et al. | 166/339 |
| 3,675,713 | 7/1972 | Watkins | 166/340 |
| 4,139,322 | 2/1979 | Tuson | 405/169 |
| 4,382,717 | 5/1983 | Morrill | 405/169 |
| 4,452,312 | 6/1984 | Roblin | 166/339 |

FOREIGN PATENT DOCUMENTS 0085280 8/1983 .

*Primary Examiner*—David H. Corbin
*Attorney, Agent, or Firm*—Alexander J. McKillop; Charles J. Speciale; Tak K. Sung

[57] ABSTRACT

A fluid operated tool 30 (FIG. 4) for use in replacing a body clamped between facing platens has an open ended tubular member 31, through which the body can pass, that carries outwardly thereof, and axially extending, coplaner support arms 33, 34 at the end of which are hydraulic piston and cylinder arrangements 35, 36 for inserting between the platens to overcome the clamping force on the body, permitting it to be removed and replaced by way of the tubular member 31. The tool may be used subsea with a submersible to handle it and provide hydraulic power.

13 Claims, 2 Drawing Sheets

CLAMPED BODY REPLACEMENT TOOL

Figure 2:
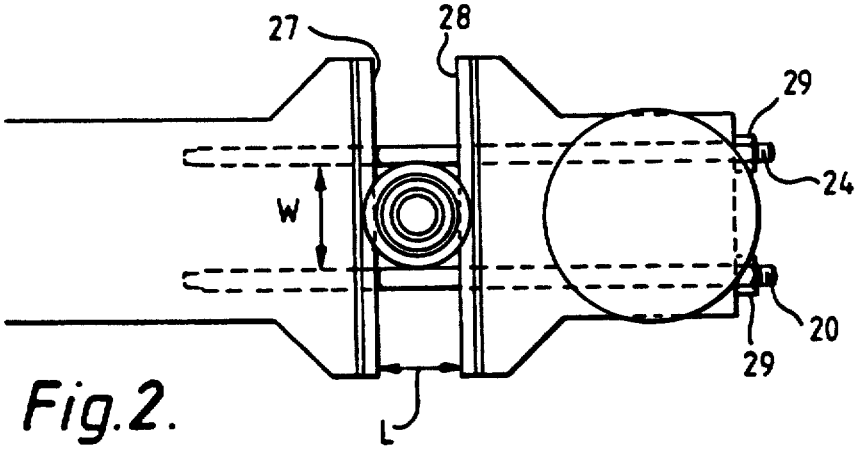

This invention relates to tools suitable for use in replacing a body held clamped between two other members and particularly, but not exclusively, to tools for performing such an operation remotely on subsea hydrocarbon producing structures.

It is known in subsea hydrocarbon-producing well structures to provide a valve with a body having in-line port faces designed to slide between two flange-like platens at facing ends of spaced axially aligned ducted members, the valve being held in situ by being clamped between the platens by pressure exerted on them by threaded members extending between the ducted members and held in tension or by other clamping means.

Such a valve body is dimensioned and the clamping members disposed in relation thereto whereby the valve body can be removed from between the platens and replaced without dismantling the structure or clamping means by applying a force to overcome the clamping pressure on the valve body.

This is done by inserting hydraulic rams or the equivalent between the facing platens and applying a separating force at least as great as the clamping force on the valve body.

Whilst this is a convenient and successful technique of replacing a subsea valve in situ, by eliminating fine manipulation and tightening of intricate clamping members that would in practice require returning the structure to the surface, it still involves careful positioning of said platen-spreading hydraulic rams correctly, so as both to exert forces in the correct directions through the structure and to avoid fouling the path of the replaced valves and their handling gear, and is only performable by a remotely controlled submersible vehicle with utmost difficulty without human intervention. Apart from the desirability as an option of performing replacement of such a valve without the need for diver presence well structures are now being used at depths beyond diver operation so that performance of the replacement operation by a remote control is a necessity.

It will be appreciated that such a technique is not limited to use with a valve body and may be used equally with a body not comprising part of a valve. Also it may be used with a valve or other body which has an axial extension at the body or platen faces which locate with corresponding recesses in the other faces, requiring the platens to be displaced or spread by the amount of this projection, the clamping means being constructed to permit such displacements.

It is an object of the present invention to provide a tool of simple construction and operation to facilitate replacement of a body supported clamped between two platens remotely by spreading the clamped body-supporting platens and which mitigates difficulties hitherto considered inherent in the replacement of a body so mounted.

According to the present invention a replacement tool for a body having opposite faces held clamped between two facing platens which extend laterally of both sides of the body comprises a hollow open ended tubular member the internal cross section of which is adapted to permit passage of the body therethrough, a pair of support arms extending axially of the tubular member from opposite sides thereof each supporting at the extremity thereof an extensible force exerting arrangement extensible in a direction substantially perpendicular to the axis of the member and the plane through the member containing the two arms, said arms and force exerting arrangements being spaced from each other by a distance greater than the width of the clamped body so as to be positioned astride the clamped body with the force exerting arrangements disposed between the platens, and force producing means operable to couple a source of extension force to the arrangements such that the force exerted by the arrangements in extending against the facing platens is sufficient to overcome the force of the platen clamping means and permit the body to be removed from between the platens through the tubular member and vice versa.

Figure 1:
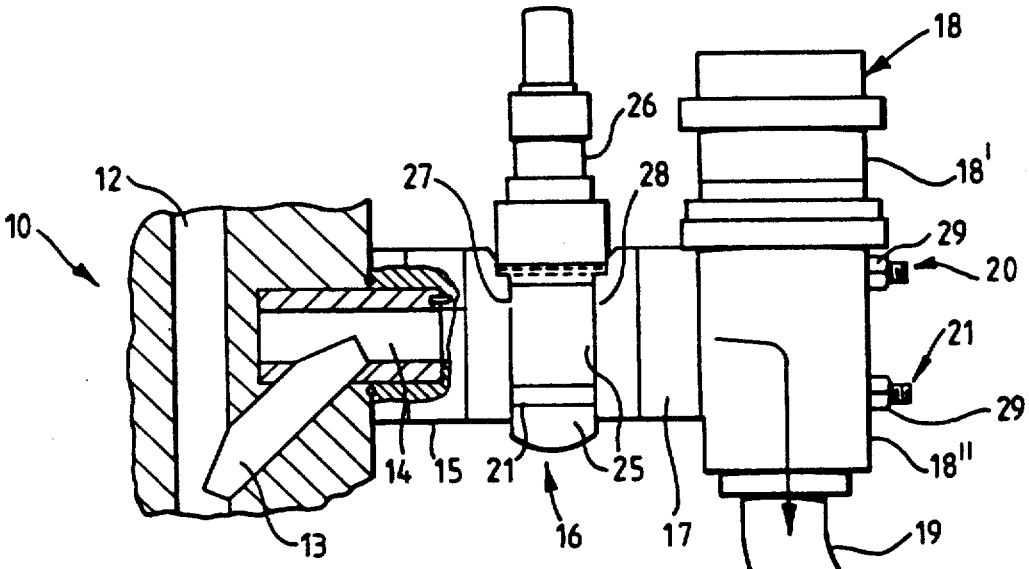
Figure 6:
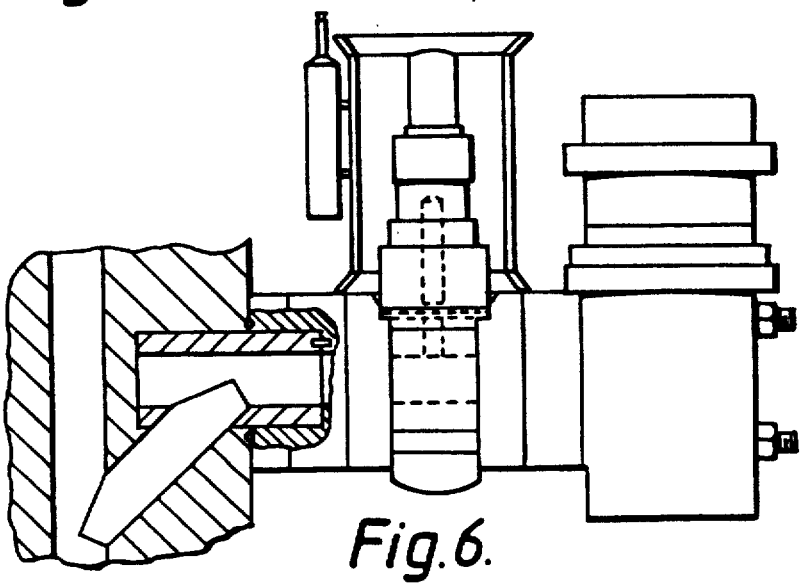
Figures 3, 4, 5, 7:
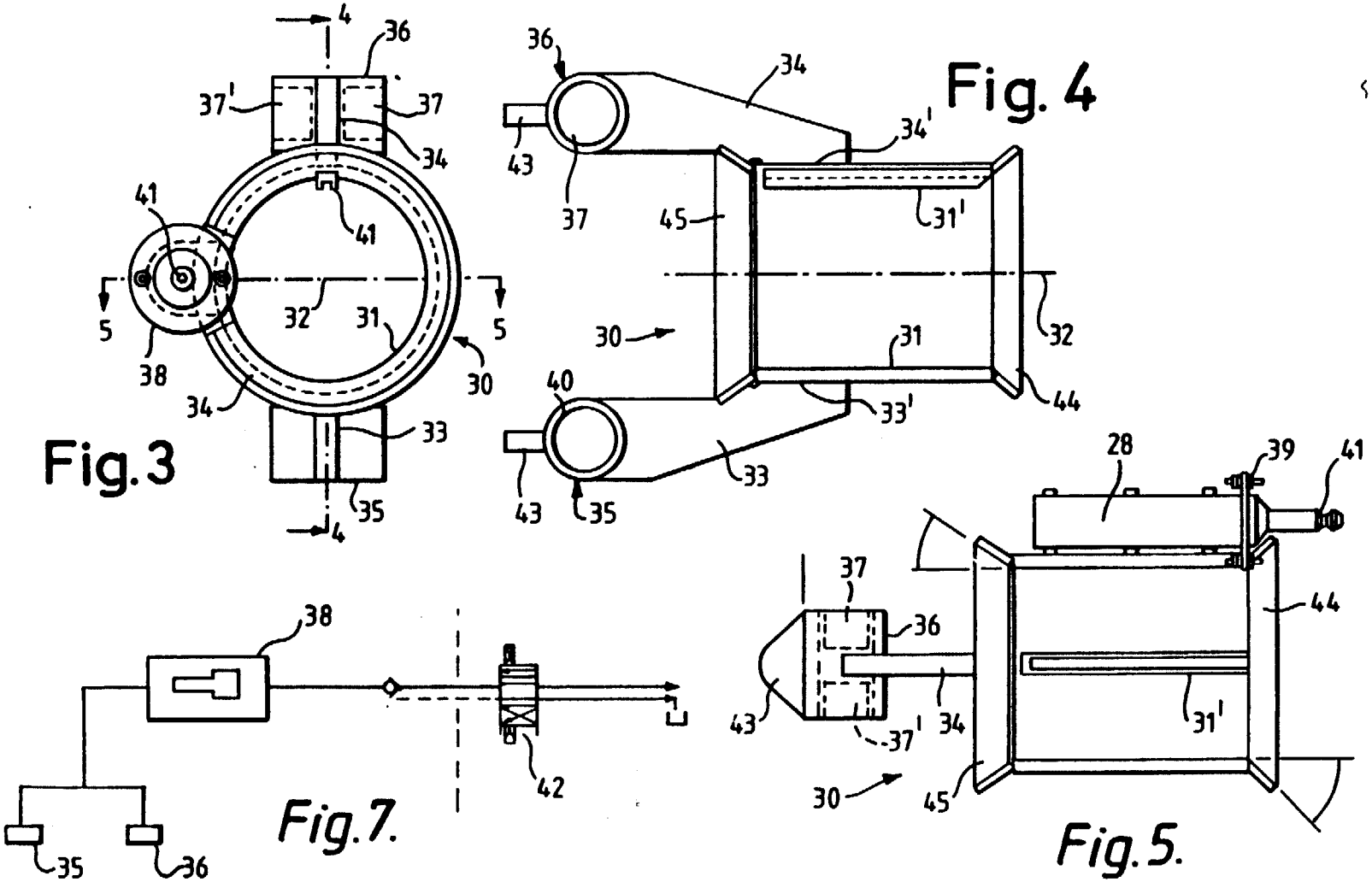

An embodiment of the present invention will now be described by way of example with reference to the accompanying drawings, in which:

FIGS. 1 and 2 are elevation and plan views respectively of a portion of a subsea hydrocarbon producing well showing the disposition of certain valve members including a sub-sea wing valve held in position solely by clamping pressure between two surrounding members and the means of applying the clamping pressure, FIG. 3 is an end view of a fluid operated tool according to the present invention, FIG. 4 is a sectional elevation through the tool along the line 4—4 of FIG. 3, FIG. 5 is a sectional elevation through the tool taken along the line 5—5 of FIG. 3, FIG. 6 is an elevation view of the well portion and clamped using valve of FIG. 1 illustrating the disposition of the replacement tool in relation thereto for operation, and FIG. 7 is a schematic hydraulic circuit diagram for operation and control of the tool.

Referring to FIGS. 1 and 2 a subsea hydrocarbon producing well 10 comprises a valve block 11 having a substantially vertical bore 12 through which hydrocarbons rise from a well (not show:). The vertical bore 12 is joined by bore 13 to a substantially horizontal bore 14 in duct member 15 secured to the block 11. The horizontal bore extends through a controllable wing valve 16 and a further duct member 17 into a choke valve 18, from which the hydrocarbons emerge in a downward direction into a flowline 19 by which they are removed from the vicinity of the well.

The use and structure of wing valve 16 and choke valve 18 are well known and require no detailed description. Their disposition in the manner described and illustrated facilitates their removal and replacement by a suspended lifting rope depending from a surface or sub-sea crane.

The working part 18' of the choke valve is removable from above without disturbing housing 18" and the housing 18", and duct member 17 are mounted in relation to duct member 15 by a number, say four, of tie rods 20–23.

The wing valve 16 has a body portion 25 with inlet and outlet ports at opposite faces thereof and a stem position 26 including control, actuation and other functional means associated with valve operation extending in a direction laterally of the flow path through the valve body between the ports, in this case vertically to facilitate lifting and lowering of the complete valve.

The width W of the wing valve body 25 in a direction perpendicular to the flow passage between ports and to the axis of stem portion 26 is no greater than the gap between adjacent upper tie rods 20 and 24 and length L between ports defines the separation of the duct members 15 and 17 which end in platens 27, 28 respectively, facing each other and extending each side of the valve body.

It will be seen from the Figures that by positioning the valve body between the facing platens nuts 29 may be tightened on the tie rods and the valve body clamped between the facing platens, the clamping force exerted by the platens due to tension in the tie rods being the sole mean of retention.

This system of dimensioning and mounting the valve was developed with the replacement of the wing valve in mind, the undesirability of removing nuts 29, choke valve housing 18" and duct member 17 in order to replace the wing valve 16 followed by reassembly and correctly tensioning the tie rods under water being apparent. To replace the wing valve the facing platens 27 and 28 are forced apart by hydraulic rams maneuvered between them, the tie rods being chosen as to length and material to absorb the additional tension without permanent deformation, and the wing valve body is slid from between the platens and a replacement inserted and aligned before the rams are removed to permit the platens, under the initial tension, to clamp the replacement wing valve in position.

This operation avoids dismantling of the flow arrangement with all the manipulation problems that entails but still requires a considerable degree of manipulation expertise in the positioning and connecting of the rams so that the forces they exert act uniformly in the required direction and through the proper points and so that they do not interfere directly or indirectly with the removal and reinstatement of a wing valve, nor suffer damage from impact by a heavy wing valve being moved to or from its location underwater.

Submersible remotely operated vehicles (ROV's) are able to assist such an operation but have limited lifting capacity and manipulation ability so that at best a diver is required to perform the operation with only the assistance of an ROV.

Referring now to FIGS. 3 to 5, in accordance with the present invention a tool 30 is provided to facilitate replacement of the wing valve 16 remotely, that is, using only a ROV and/or lifting or lowering device in conjunction with the tool. The tool 30 comprises a hollow open ended tubular member 31, conveniently comprising a right circular cylinder, having longitudinal axis 32 and a diameter great enough to permit the passage of the valve therethrough. For the valve 16 illustrated it will be seen (in FIGS. 1 and 2) that the stem portion 26 not forming the valve body 25 may in fact have one or more dimensions greater than the valve body and it is the overall dimensions of the valve, not just the valve body which are accommodated by the tubular member.

A pair of support arms 33, 34 extend axially of the tubular member from opposite sides thereof, the arms being formed of bars attached to the tubular member at diametrically opposite points 33' and 34' along the outer tubular walls so that they are separated from each other by greater than the diameter of the tubular member.

The bars are of greater dimension in the direction radially outwards of the tubular member than in the orthogonal direction and are essentially coplanar.

The support arms 33 and 34 carry at the extremities thereof extensible force exerting arrangements 35, 36 respectively comprising fluid pressure activated forcing piston and cylinder. Each forcing cylinder contains at least one axially reciprocable piston, shown ghosted at 37 preferably adapted to retract flush with the end of the cylinder. The forcing cylinder 36 may contain a second axially reciprocable piston 37' aligned with the piston 37 and displaceable oppositely with respect thereto. The length of cylinder and retracted piston combination is arranged to be slightly less than the separation of the facing platens 27, 28 of the clamped valve structure.

The forcing cylinder 36 is supplied with pressurised actuating fluid, conveniently hydraulic fluid, by fluid coupling means comprising pipework (not shown) from fluid pressure intensifier 38 carried along the outside of the tubular member which in turn receives fluid at a lower pressure at tool connection 39 from an external source such as the hydraulic circuit of an ROV. ROV's operate on relatively low hydraulic pressures, of the order of 200 Bar and the use of a known type of intensifier providing say, 7 times pressure magnification enables a fluid pressure of some 1400 Bar to be made available to the forcing cylinder 36.

The forcing cylinder 35 with its piston 40 is identical with the piston and cylinder arrangement 36/37 and operates in parallel therewith upon the coupling thereof to the external fluid source.

The forcing cylinders are disposed with the reciprocation axis of their pistons parallel to each other and orthogonal to both the longitudinal axis 32 of the tubular member and to the diametrical plane containing the support arms 33 and 34.

The widths of support arm 33 and 34 are conveniently substantially equal to the outside diameters of the respectively forcing cylinder 35 and 36 so as to provide uniform support, and to hold the cylinders separated from each other by no less than the internal diameter of the tubular member.

The tool 30 also includes handling means 41 in the form of a profiled peg adapted on the inside wall of the tubular member to cooperate with handling means of an ROV whereby the ROV can transport the tool, orientate it and dispose it in relation to the structure containing the wing valve. To use the tool it is brought to the structure and the tubular member is passed over the valve stem portion 26 and orientated about the stem portion so that the forcing cylinders and their support arms extend into the space between the facing platens 27, 28 astride the valve body 25 with the forcing pistons 37 (37'), 40 (40') facing one (or both) platens.

The ROV which positions the tool provides hydraulic fluid from its own circuit to the coupling means 39 which forces the facing pistons from their cylinders to abut one platen and react with the cylinder or second piston against the other platen, overcoming the clamping force of the tensioned tie rods.

Clearly it is desirable that the tie rods should not be tensioned beyond their elastic limits and to this end each piston cylinder combination may be provided with limiting means which comprises either a physical stop to limit the piston travel or a pressure release means to limit the spreading force applied to the platens.

Once the clamping pressure on the wing valve body is overcome the wing valve is removed by way of the tubular member, which is now securely fixed with respect to the structure by the forcing piston and cylinder arrangements, which member constrains the direction of removal of the valve from the structure so as to avoid any damaging impacts between relatively moving parts or between the removed valve and the vulnerable coupling hydraulic of the tool.

A replacement valve is positioned by lowering it into the tubular member such that it, or at least portion 25, passes therethrough and locates between the facing platens and tie rods. The fluid pressure is thereafter reduced, permitting the original tension in the tie rods 20–23 to draw the facing platens towards each other and re-establish clamping pressure on the wing valve body, and the tool is removed from the structure by lifting the tubular body over the stem portion 26 of the wing valve.

It will be appreciated that several detailed variations of, and refinements to, the above are possible.

For instance, when the tool is positioned by the ROV and held to the structure by the forcing piston and cylinder arrangements the ROV may decouple the handling means to give more room for manipulation of the valve and its replacement. The hydraulic coupling may be maintained, with the connection to the ROV being by a flexible base or the like which permits the ROV to stand off during valve replacement or to participate in the valve replacement with the handling means recently decoupled from the tool.

The fluid coupling means may contain control means, a schematic hydraulic circuit diagram of which is shown in FIG. 7, including a control valve 42 operable to lock the fluid in the forcing piston and cylinder arrangements to latch them in the extended piston. If such a control valve 42 is carried by the tool the ROV may be decoupled completely from the tool for the valve replacement operation, although both the fluid supply and control connections are required when coupled. Such a latching control arrangement may be provided on the ROV and latching be likewise effected, even though the ROV can no longer be decoupled from the fluid circuit.

As an alternative to disconnecting and removing the ROV handling means from the tool only after the forcing cylinders have been pressurised, and to assist in locating and possibly orientating the forcing cylinders, the tubular member may be provided with internal surface constructions such as 31' which cooperate with existing or specially provided surface structures of the stem portion 26 of the valve. Such a cooperating arrangement may also be used to align the orientation of the replacement valve with respect to the space between the plates.

Irrespective of any such locating surfaces it will be appreciated that to effect tool installation as the tubular body is moved over the stem portion 26 the plane of the support arms has to be aligned with respect to the platen faces to permit the similarly sized forcing cylinders to slide therebetween. To assist in such alignment each of the forcing cylinders 35 and 36 is provided on the side away from its support arm, that is, the leading edge of the tool as it approaches the platen, with a guide projection 43 tapering to a point in the plane of piston and cylinder extension. These projections guide, that is, centralise, the forcing cylinder with respect to the space between the platens as they are brought towards then astride the clamped valve body.

Furthermore, when tubular member 31 is located over the valve stem to avoid any deleterious effects of the extremity of the valve stem abutting the end of a badly aligned tubular member the end of the tubular member may be provided with a guide funnel 44. Similarly, to assist a replacement valve pass through the installed body member the other end may be provided with a guide funnel 45.

It will be appreciated that the tool may be used in replacement of a clamped body which is other than a valve and a body which does not have a laterally extending, or upstanding, equivalent of the valve stem portion 26 illustrated. The tool construction and operation is still as described, with the guide projections 43 on forcing cylinder and guide funnel 45 assuming greater importance in positioning the tool and ensuring the unclamped body is passed into, and through, the tubular member without problem.

Although the tool has been described as operated by, and in association with, a submersible ROV it will be understood that the tool may be installed and removed by other means, such as by lowering on a suspended line in the vertical direction, and may be used by a diver, where one is at work, to simplify and speed up a body replacement operation.

The shape of the tubular member is not restricted to being circular cross section, nor are the support arms necessarily connected to diametrically opposite wall portions nor of the shape and disposition shown, provided they support the forcing cylinders astride the clamped body and permit its removal through the tubular member. As an example the support arms may comprise integral extended portions of the tubular member.

It will be appreciated that a tool as described may be used with a clamped body which is not a simple sliding fit between the clamping platens but one which is located between them by small cooperating axial projections and recessed in the body and platen faces. Replacement of such a body requires not only that the clamping pressure of the clamping means, such as the tensioned tie rods, is equalled but is overcome and the platens moved apart or spread by the extent of such body-locating projections.

Also it will be appreciated that the tool is not dependent on the form of clamping applied to the platen surfaces and requires only that the forcing cylinders be slidable between and from the facing platens astride the body to permit its displacement by way of the tubular member.

The tool hitherto described overcomes the clamping force on the body to be replaced by means of extensible force exerting arrangements comprising fluid pressure actuated piston and cylinder arrangements. In subsea applications with hydrocarbon well structures the forces involved are such as to practicably require a hydraulic fluid, if supplied by an ROV, to be intensified. In different circumstances, where forcing cylinder dimensions are different or the clamping forces are less, the intensifier may not be required. Similarly, if the fluid is available from a source at the required end pressure the intensifier may be omitted. Likewise pressured fluid other than hydraulic fluid may be used where appropriate, such as a gas in a pneumatic circuit.

Alternative forms of extensible force exerting arrangements may be provided where the forces they exert are suitable. For example, a housing corresponding to the forcing cylinder described above may house an extensible piston-like member displaced by other means, such as being formed as a nut on a rotating lead screw or as an axially displaced rotating screw jack, the extension force producing means then comprising fluid turbine or electric motor drive.

It will be appreciated from the above, and particularly the discussion of alternatives that the tool may be used in situations other than subsea, which are hostile and require remote handling techniques, such as in explosive or radioactive environments.

We claim:

1. A replacement effecting tool for a body having opposite faces held clamped between two facing platens which extend laterally of both sides of the body, the tool comprising a hollow open ended tubular member, the internal cross section of which is adapted to permit passage of the body therethrough, a pair of support arms extending axially of the tubular member from opposite sides thereof, each arm supporting at the extremity thereof an extensible force exerting arrangement extensible in a direction substantially perpendicular to an axis of the member and a plane through the member containing the two arms, said arms and force exerting arrangements being spaced from each other by a distance greater than the width of a clamped body so as to be positioned astride the clamped body with the force producing means disposed between the platens, and force producing means operating in such way that the force exerted by the arrangement in extending against the facing platens is sufficient to overcome the force in clamping of the platens and permit the body to be removed from between the platens through the tubular member and vice versa.

2. A tool as claimed in claim 1 in which the support arms and force exerting arrangements are separated from each other by a distance greater than the internal width of the tubular member, the arms being attached to the tubular member at points along the outer tubular wall of the member.

3. A tool as claimed in claim 1 or claim 2 in which the tubular member is a right circular cylinder with the support arms extending from diametrically opposite points thereof.

4. A tool as claimed in claim 1 in which each of the force exerting arrangements is provided on the side away from the direction of its support arm extension with a guide projection tapering to a point in the plane of force arrangement extension and operable to guide the arrangement with respect to the space between the facing platens as the support arms are brought towards and astride the clamped body.

5. A tool as claimed in claim 1 including limiting means operable to limit the forcing pressure applied by the forcing arrangement to the platens.

6. A tool as claimed in claim 5 in which the limiting means comprises means to limit the extension of each forcing arrangement.

7. A tool as claimed in claim 1 in which at least one end of the tubular member has a guide funnel thereinto for the passage of a body therethrough.

8. A tool as claimed in claim 1 including handling means disposed on the tubular member cooperable with handling means of a remote handling device to facilitate its positioning with respect to the clamped body thereby.

9. A tool as claimed in claim 1 in which each force exerting arrangement comprises a fluid pressure operated piston and cylinder arrangement responsive to pressurised fluid in the cylinder to exert between the cylinder and piston a force driving the piston out of the cylinder to extend the arrangement and the force producing means comprises fluid coupling means operable to couple a source of pressurised fluid to the pair of cylinders.

10. A tool as claimed in claim 9 in which each of the forcing cylinders includes a pair of aligned pistons oppositely displaceable out of the cylinder by fluid pressure therein to abut one each the facing platens.

11. A tool as claimed in claim 9 in which the forcing piston and cylinder arrangements are operated by hydraulic fluid and in which the coupling means comprises a connection to a source of hydraulic fluid and a hydraulic pressure intensifier, disposed between the connection and the forcing cylinders, operable to increase the pressure of hydraulic fluid supplied to the forcing cylinders from that at which supplied to the tool.

12. A tool as claimed in claim 11 in which the intensifier is located outside of, and extends along, the tubular member wall.

13. A tool as claimed in claim 9 including control means operable to latch the forcing piston and cylinder arrangement extended under pressure by isolating the supply of fluid to the coupling means.

* * * * *